US010598192B2

(12) United States Patent
Bukland et al.

(10) Patent No.: US 10,598,192 B2
(45) Date of Patent: Mar. 24, 2020

(54) ACOUSTIC-RESONANCE FLUID PUMP

(71) Applicant: The Technology Partnership Plc, Royston, Hertfordshire (GB)

(72) Inventors: Justin Rorke Bukland, Cambridge (GB); Stuart Andrew Hatfield, Cambridge (GB); Stephanie April Weichert, Cambridge (GB); David Martin Pooley, Cambridge (GB)

(73) Assignee: TTP VENTUS LIMITED, Melbourn, Royston, Hertforshire (GB)

( * ) Notice: Subject to any disclaimer, the term of this patent is extended or adjusted under 35 U.S.C. 154(b) by 220 days.

(21) Appl. No.: 15/104,080

(22) PCT Filed: Dec. 12, 2014

(86) PCT No.: PCT/GB2014/053690
§ 371 (c)(1),
(2) Date: Jun. 13, 2016

(87) PCT Pub. No.: WO2015/087086
PCT Pub. Date: Jun. 18, 2015

(65) Prior Publication Data

US 2017/0002839 A1 Jan. 5, 2017

(30) Foreign Application Priority Data

Dec. 13, 2013 (GB) ..... 1322103.1

(51) Int. Cl.
*F04B 45/047* (2006.01)
*F04B 43/04* (2006.01)
(Continued)

(52) U.S. Cl.
CPC ..... *F04F 7/00* (2013.01); *F04B 43/046* (2013.01); *F04B 45/047* (2013.01);
(Continued)

(58) Field of Classification Search
CPC ..... F04F 7/00; F04B 53/16; F04B 49/225; F04B 45/047; F04B 43/046; F04B 2203/0406
See application file for complete search history.

(56) References Cited

U.S. PATENT DOCUMENTS 3,360,664 A * 12/1967 Straube ..... B06B 1/0603 307/400
6,203,291 B1 3/2001 Stemme et al.
(Continued)

FOREIGN PATENT DOCUMENTS

DE 4422743 A1 6/1994
DE 19539020 A1 10/1995
(Continued)

OTHER PUBLICATIONS

International Search Report corresponding to International Application No. PCT/GB2014/053690, dated Apr. 17, 2015, 3 pages.
(Continued)

*Primary Examiner* — Devon C Kramer
*Assistant Examiner* — David N Brandt
(74) *Attorney, Agent, or Firm* — Tarolli, Sundheim, Covell & Tummino LLP

(57) ABSTRACT

A fluid pump includes a pump body having upper and lower parts, each comprising a substantially cylindrical side wall closed at one end by a substantially circular end wall and partially closed at the opposite end by an actuator disposed in a plane substantially parallel to and between the end walls. A single cavity is thereby formed having upper and lower portions. The cavity encloses the actuator and is bounded by the end walls and side walls of the pump body and the surfaces of the actuator. A substantially open actuator support structure connects the actuator to the pump body and enables free flow of fluid between the upper and lower cavity portions. At least two apertures are provided through the pump body walls, at least one of which is a valved
(Continued)

aperture. All of the apertures located substantially at the centres of the end walls are valved apertures. In use, the actuator oscillates in a direction substantially perpendicular to the plane of the end walls causing an acoustic wrapped standing wave to exist in the cavity and thereby causing fluid flow through said apertures.

22 Claims, 9 Drawing Sheets

(51) Int. Cl.
*F04B 53/16* (2006.01)
*F04F 7/00* (2006.01)
*F04B 49/22* (2006.01)

(52) U.S. Cl.
CPC ..... *F04B 49/225* (2013.01); *F04B 53/16* (2013.01); *F04B 2203/0406* (2013.01)

(56) References Cited

U.S. PATENT DOCUMENTS

| | | | | |
|---|---|---|---|---|
| 7,553,135 | B2 * | 6/2009 | Cho | F04B 43/046 361/688 |
| 7,972,124 | B2 * | 7/2011 | Hirata | F04B 39/1093 417/413.2 |
| 8,123,502 | B2 * | 2/2012 | Blakey | F04B 43/046 417/413.1 |
| 8,325,477 | B2 * | 12/2012 | Ishikawa | F04F 7/00 165/80.3 |
| 9,103,337 | B2 * | 8/2015 | Hirata | F04B 43/046 |
| 9,127,665 | B2 * | 9/2015 | Locke | F04B 43/023 |
| 9,506,463 | B2 * | 11/2016 | Locke | F04B 43/046 |
| 9,506,464 | B2 * | 11/2016 | Hirata | F04B 17/003 |
| 10,107,281 | B2 * | 10/2018 | Tanaka | F04B 45/047 |
| 2004/0000843 | A1 | 1/2004 | East | |
| 2005/0001287 | A1 | 1/2005 | Aisenbrey | |
| 2011/0076170 | A1 * | 3/2011 | Fujisaki | F04B 45/047 417/415 |
| 2013/0071273 | A1 | 3/2013 | Locke | |
| 2015/0071797 | A1 * | 3/2015 | Takeuchi | F04B 43/0054 417/413.2 |

FOREIGN PATENT DOCUMENTS

| | | | |
|---|---|---|---|
| JP | 6066883 | | 3/1985 |
| JP | 2008537057 | A | 9/2008 |
| JP | 2010151012 | A | 7/2010 |
| JP | 2012528980 | A | 11/2012 |
| WO | 2013134056 | A1 | 9/2013 |
| WO | 2012140967 | A1 | 7/2014 |

OTHER PUBLICATIONS

Notice of Reason for Rejection dated Nov. 9, 2018 for corresponding JP Patent Application No. 2016-539068, and English translation thereof.

* cited by examiner

ACOUSTIC-RESONANCE FLUID PUMP

RELATED APPLICATIONS

The present application is a U.S. National Stage under 35 USC 371 patent application, claiming priority to Serial No. PCT/GB2014/053690, filed on Dec. 12, 2014, which claims priority from GB 1322103.1, filed on Dec. 13, 2013, both of which are incorporated herein by reference.

BACKGROUND OF THE INVENTION

Field of the Invention

The illustrative embodiments of the invention relate to a fluid pump, in particular a novel acoustic-resonance fluid pump which provides benefits in size, efficiency and assembly over previous designs, overcoming limitations in the related art.

Description of Related Art

As a wide range of markets trend towards reduced size, highly integrated, compact and convenient products, there is a strong requirement for increasingly small, discrete fluid pumps capable of providing high pump performance.

A large number of the miniature fluid pumps in the known art are displacement pumps, i.e., pumps in which the volume of the pumping chamber is made smaller in order to compress and expel fluids through an outlet valve and is made larger so as to draw fluid in through an inlet valve. An example of such a pump is described in DE4422743 ("Gerlach"), and further examples of displacement pumps may be found in US2004000843, WO2005001287, DE19539020, and U.S. Pat. No. 6,203,291. Whilst the use of piezo driven displacement pumps has enabled small devices, the pump performance is limited by the small positive displacements achieved by the piezo diaphragms, and the low operation frequencies used.

An alternative method which can be used to achieve fluid pumping is use of acoustic resonance. This can be achieved using a long cylindrical cavity with an acoustic driver at one end, which drives a longitudinal acoustic standing wave. In such a cylindrical cavity, the acoustic pressure oscillation has limited amplitude. Varying cross-section cavities, such as cone, horn-cone, and bulb have been used to achieve higher amplitude pressure oscillations, thereby significantly increasing the pumping effect. In such higher amplitude waves, non-linear mechanisms which result in energy dissipation are suppressed by careful cavity design. Until recently, high amplitude acoustic resonance has not been employed within disc-shaped cavities in which radial pressure oscillations are excited. International Patent Application No. PCT/GB2006/001487, published as WO 2006/111775 (the '487 application), discloses a pump having a substantially disc-shaped cavity with a high aspect ratio, i.e., the ratio of the radius of the cavity to the height of the cavity.

The pump described in the '487 application is further developed in related patent applications PCT/GB2009/050245, PCT/GB2009/050613, PCT/GB2009/050614, PCT/GB2009/050615, PCT/GB2011/050141. These applications and the '487 application are included herein by reference.

The acoustic resonance pumps described in the '487 Application and the related applications listed above operate on a different physical principle to the displacement pumps in the related art. In acoustic resonance pumps there exists, in operation, an acoustic standing wave within the pump cavity such that the fluid is compressed within one part of the cavity while the fluid is simultaneously expanded in another part of the cavity. In contrast to a more conventional displacement pump, an acoustic resonance pump does not require a change in the cavity volume in order to achieve pumping operation. Instead, its design is adapted to efficiently create, maintain, and rectify the acoustic pressure oscillations within the cavity.

Turning to its design and operation, the '487 application describes an acoustic resonance pump which has a substantially cylindrical pump body comprising a substantially cylindrical side wall closed at each end by end walls, one or more of which is a driven end wall. The driven end wall is associated with an actuator that causes an oscillatory motion of the end wall ("displacement oscillations") in a direction substantially perpendicular to the end wall (i.e. substantially parallel to the longitudinal axis of the cylindrical cavity) referred to hereinafter as "axial oscillations" of the driven end wall. The axial oscillations of the driven end wall generate substantially proportional pressure oscillations of fluid within the cavity creating a radial pressure distribution approximating that of a Bessel function of the first kind as described in the '487 application; such pressure oscillations are referred to hereinafter as "acoustic standing waves" within the cavity.

The pump disclosed in the '487 application includes one or more valves for controlling the flow of fluid through the pump and, more specifically, valves capable of operating at high frequencies as it is preferable to operate the pump at frequencies beyond the range of human hearing. Such a valve is described in International Patent Application No. PCT/GB2009/050614. The combination of the high amplitude pressure oscillations provided by the acoustic resonance pump and high operational frequency valve(s) enables a high pump performance within a small device size.

There are however some limiting aspects of this related art.

Firstly, as taught by the '487 application, the radial pressure distribution of the acoustic standing wave approximates that of a Bessel function, in which the oscillation frequency (f) and the cavity radius (a) are related by $$a \cdot f = \frac{k_0 c}{2\pi} \qquad \text{Equation 1}$$

where $k_0$ is a Bessel function constant (~3.8) and c is the speed of sound. This shows that the cavity radius, which is typically the largest linear dimension of the pump, is determined by the operating frequency of the pump. Therefore, in order to significantly reduce the size of the acoustic resonance pump described in '487 and the related art, the frequency of operation must be increased in inverse proportion.

However, as taught by the '614 application, for a flap valve to effectively rectify a pressure oscillation, the valve flap must move between open and closed positions in a time of less than one quarter of the period of the pressure oscillation. This requirement places constraints on the valve design described in the '614 application, summarised in the inequality below, where the valve flap thickness ($\delta_{flap}$), valve flap density ($\rho_{flap}$) and the distance between the open and closed positions ($d_{gap}$) are related to the pressure oscillation frequency f and amplitude P.

$$\delta_{flap} < \frac{P}{2d_{gap}} \frac{1}{16f^2} \frac{1}{\rho_{flap}} \quad \text{Equation 2}$$

A fast valve response, and hence high pump efficiency are achieved when the right-hand side of the inequality is significantly larger than the left-hand side. Therefore for a given valve design an increase in pump operating frequency can result in a significant reduction in pump efficiency.

In summary, for the acoustic resonance pumps described in the related art, reducing the size of the pump by reducing the cavity radius results in higher operational frequency and hence reduced valve efficiency and reduced pump performance Secondly, the related art generally describes acoustic standing waves having two pressure anti-nodes: for example in the '487 application the first anti-node is located at the centre of the cavity and the second anti-node is located at its perimeter, with a radial node in between.

At the central pressure anti-node the pressure amplitude is usually highest, and so an optimal location for a valved aperture is centred in the pump body end wall. The pressure anti-node at the perimeter of the cavity is lower in amplitude and dispersed spatially compared to the central anti-node, and thus it is in practice more difficult to valve efficiently in order to deliver pumped flow. However, the compression and expansion of the fluid in this perimeter region leads to thermal and viscous losses in the fluid regardless. In short, the presence of a perimeter anti-node offers limited advantage in delivering useful pumped flow, but reduces pump efficiency by introducing losses.

Finally, in one embodiment of the acoustic resonance pump described in the '487 application, two acoustic pump cavities are driven by a single actuator. This enables various configurations in which the outputs of the cavities are combined in series or parallel to deliver either higher pressure or higher flow operation. A complication of combining cavities in this way is that un-valved inlets or outlets must be placed approximately at the radial node in the pressure distribution, i.e. at approximately 0.63a from the pump axis. Providing and manifolding such inlets and/or outlets in the end-walls of the cavities increases the mechanical complexity of such a pump, potentially increasing its size and the cost of its components, both commercially undesirable outcomes.

Therefore, there is a need for a fluid pump which can overcome these limitations.

SUMMARY

The design of a novel acoustic resonance pump is disclosed. The novel design overcomes the aforementioned limitations related to the size, performance and complexity of the pumps described in the related art. Other objects, features, and advantages of the illustrative embodiments are disclosed herein and will become apparent with reference to the drawings and detailed description that follow.

The present invention provides a pump comprising a pump body formed around an actuator and support structure to create a single fluid-filled cavity which encloses the actuator. A support structure, which connects the actuator to the side or end walls of the cavity, is preferably designed so as to substantially constrain or limit the axial motion of the perimeter of the actuator while having a substantially open structure allowing largely unobstructed air flow through around the perimeter of the actuator. In use, axial oscillations of the driven actuator cause pressure oscillations in the fluid within the cavity creating an acoustic standing wave within the cavity which 'wraps' around the actuator. Valved apertures are provided in the walls of the pump body. In use, the valves within the valved apertures rectify the pressure oscillations within the cavity and provide a pumping effect.

BRIEF DRAWINGS DESCRIPTIONS

FIGS. 1A-D are schematic cross-sections of related art showing actuator displacement profiles (A and B) and standing wave mode structures in the cavity (C and D);

FIGS. 2A-D are schematic cross-sections of embodiments of the current invention showing actuator displacement profiles (A and B) and standing wave mode structures in the cavity (C and D);

FIGS. 3A-B are schematic cross-sections comparing the actuator displacement profile and relative cavity size of an embodiment of the present invention (A) with the related art (B);

FIGS. 4A-C are schematic cross-sections through the end wall of three embodiments of the present invention. The arrows show the flow of fluid through the embodiments;

FIGS. 7A-F are schematic cross-sections through the end wall which illustrate examples of support structure embodiments of the present invention;

FIGS. 8A-B are schematic plan views in the actuator plane illustrating additional examples of support structure embodiments of the present invention.

Figure 9:
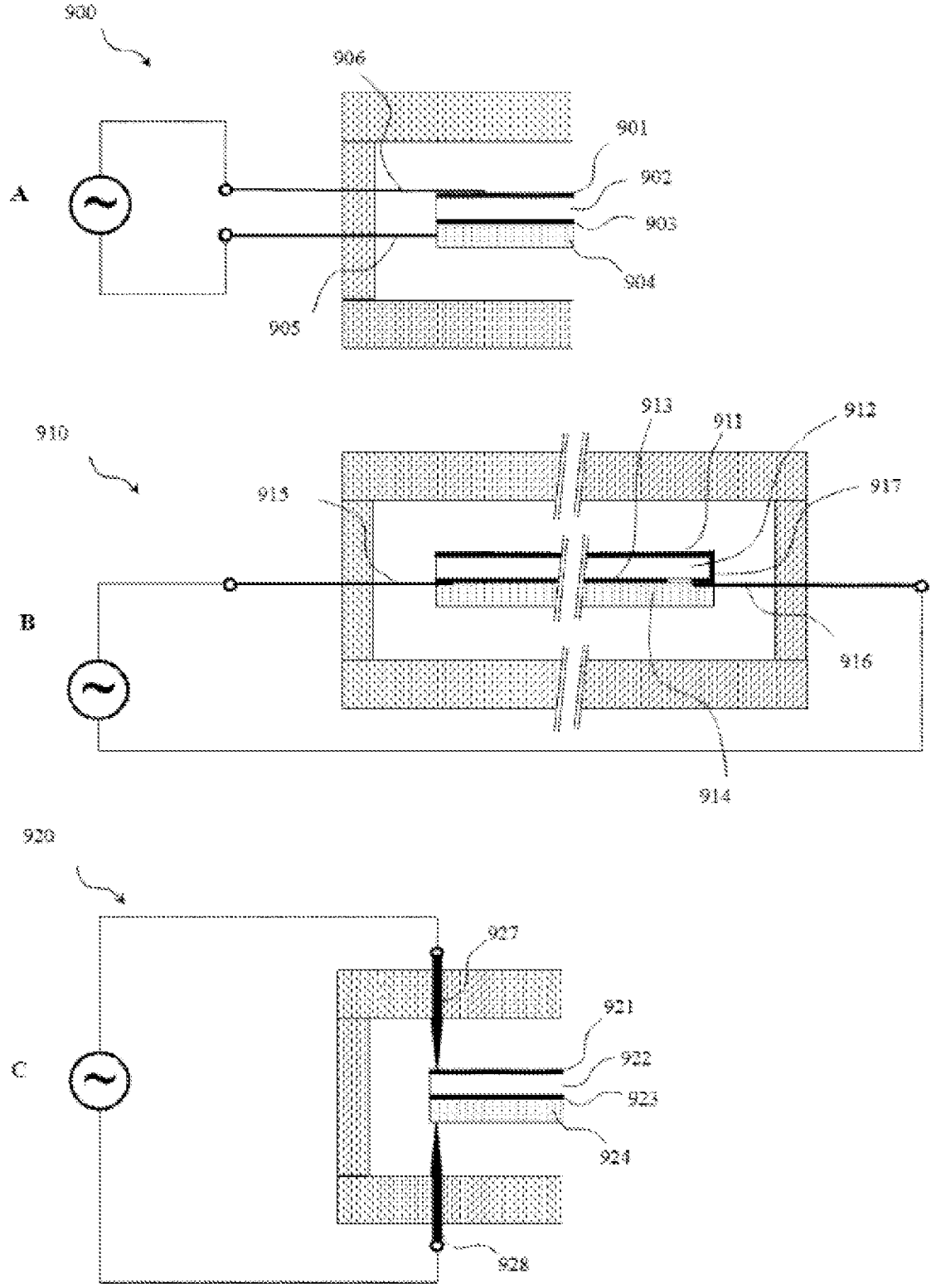
Figure 10:
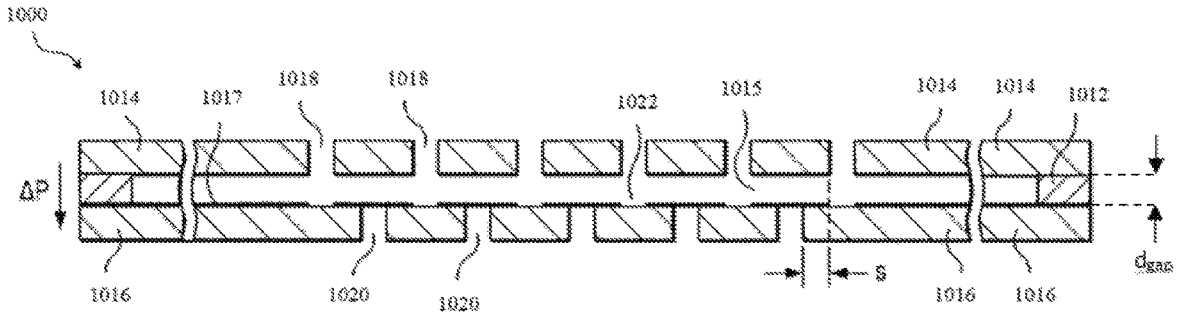

FIGS. 9A-C are schematic cross-sections of embodiments of the current invention showing three methods of creating electrical connections to the piezoelectric actuator;

FIG. 10 is a schematic cross-section through an embodiment of a high-frequency valve which may be suitable for use in the present invention;

DETAILED DRAWING DESCRIPTION

FIGS. 1A-D are schematic cross sections of a substantially cylindrically pump (100) described in the related art (the '487 application) in which a cavity (101) is defined by a side wall (102), an end wall (103), and an actuator (104) mounted on an isolator (105).

FIG. 1A shows one possible driven actuator displacement profile in which the centre of the actuator is displaced away from the cavity (101). The curved dotted line (111) indicates the actuator displacement at one point in time of the actuator oscillation. FIG. 1B shows another possible driven actuator displacement profile in which the centre of the actuator is displaced into the cavity (101). The curved dotted line (112) indicates the actuator displacement one half-cycle after the actuator displacement profile (111) shown in FIG. 1A. The actuator displacements indicated in FIG. 1A and FIG. 1B are exaggerated. The actuator (104) oscillates substantially about its centre of mass, which leads to the presence of the displacement anti-nodes at the centre (113) and at the perimeter (114) of the actuator. The isolator (105) is designed to ensure that the perimeter of the actuator (104) is able to move in an axial direction without substantial constraint.

FIGS. 10 and 1D show the sign of the pressure amplitude relative to ambient cavity pressure of the resulting acoustic standing wave, indicating the regions of the cavity (101)

where the pressure is positive (hatched, 115) or negative (open, 116). The approximate positions of the central pressure anti-node (121) and perimeter anti-node (122) are indicated. The pressure distribution has substantially circular symmetry. At the interface between the positive and negative pressure regions (115) and (116) is a circular pressure node (117). We term such schematic depictions of the pressure regions and nodes the "mode structure". FIG. 10 indicates the mode structure at one point in time; FIG. 1D indicates the mode structure one half-cycle later. The acoustic standing wave described above results from the superposition of an acoustic wave travelling radially outwards, and the reflected wave travelling radially inwards from the side wall (102) where the reflection occurs. The maximum radial fluid velocity is at the pressure node (117) and the radial fluid velocity at the anti-nodes (121 and 122) is zero.

For a cylindrical cavity, the radial dependence of the amplitude of the pressure oscillations u(r) in the cavity (101) may be approximated by a Bessel function of the first kind, as described by the following equation:

$$u(r)=J_o(k_o r/a) \qquad \text{Equation 3}$$

where u is pressure amplitude, $J_o$ is the Bessel function, $k_o$ is the Bessel function constant, r is the radial position, and a is the characteristic radius.

Figure 1:
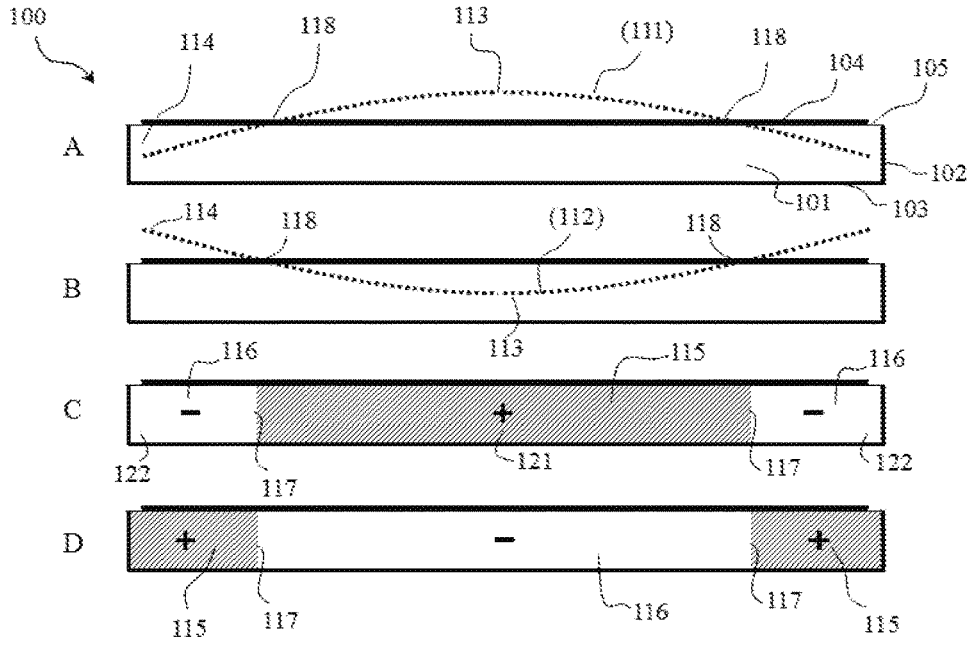
FIG 1 (Prior Art)

For the cavity shown in FIG. 1, the pressure distribution depends on a Bessel function constant of $k_0$~3.8 and the characteristic radius a is defined by the cavity radius.

Note that the mode shape of the actuator displacement is selected to substantially match the pressure distribution of the acoustic standing wave within the cavity, but that the phase relationship between the two is not fixed and a particular phase relationship should not be inferred.

FIGS. 2A-D are schematic cross sections for a substantially cylindrically pump (200) illustrating an embodiment of the present invention in which a single cavity (209) is defined by a side wall (203) and two end walls (204) and (205). The cavity (209) fully encloses an actuator (206) which defines two regions of the cavity; the region above the actuator (206) which we shall term the upper cavity portion (201) and the region which lies below the actuator (206) which we shall term the lower cavity portion (202). Critically, although the actuator separates the upper and lower cavity portions close to the centre of the cavity, they are fluidically joined at the perimeter so as to create a single continuous cavity which wraps around the actuator. Not shown in FIG. 2A-D is a mechanical support structure required to hold the actuator in the centre of the cavity without significantly disrupting the acoustic resonance in the cavity. The mechanical support structure is described in FIG. 7 A-F.

FIG. 2A shows one possible driven actuator displacement profile when the actuator (206) is displaced into the upper cavity portion (201). The curved dotted line (211) indicates the actuator displacement at one point in time during the actuator oscillation. FIG. 2B shows another possible driven actuator displacement profile when the actuator (206) is displaced into the lower cavity portion (202). The curved dotted line (212) indicates the actuator displacement one half-cycle after the actuator displacement profile (211) in FIG. 2A. In this case (FIGS. 2A and 2B) the actuator displacement has an anti-node at the centre of the actuator (213) and a node at its edge (214). The actuator displacement as drawn is exaggerated. As the actuator is fully enclosed by the cavity (209), any motion of the actuator will result in an equal and opposite change in volume in the upper (201) and lower (202) cavity portions, and the overall volume of the cavity (209) remains constant. FIGS. 2C and 2D show the acoustic standing wave mode structure which results from the actuator oscillations described by FIGS. 2A and 2B. The mode structure indicates the regions of the cavity (209) where the pressure is positive relative to ambient cavity pressure (hatched, 215) or negative (open, 216). The approximate position of the two pressure anti-nodes (221) and (222) are indicated. At the interface between the positive and negative pressure regions (215) and (216) is a pressure node (217). Note the node (217) is substantially in the plane of the actuator and extends from the perimeter of the actuator to the perimeter of the cavity. FIG. 2C indicates the mode structure at one point in time; FIG. 2D indicates the mode structure one half-cycle later. The acoustic standing wave described results from an acoustic wave travelling radially outwards from one pressure anti-node in one cavity portion, travelling around the perimeter of the actuator and then travelling radially inwards towards the second anti-node in the other cavity portion, combined with the equivalent counter-propagating travelling wave. The superposition of the counter-propagating travelling waves at the two pressure anti-nodes results in a standing wave which 'wraps' around the actuator, which we shall term a "wrapped standing wave". It should be noted that this ideally forms one single mode of oscillation and the cavity should be designed to minimize reflections, e.g., at its edge. Unlike the pump (100) described in the related art, in an ideal embodiment of the pump (200) there will be no reflections of the acoustic waves from the side wall (203) as they travel around the cavity.

In the wrapped standing wave, the fluid velocity as affected by the driven actuator is a maximum at the pressure node as it passes around the edge of the actuator and is zero at the anti-nodes (222) and (221).

Figure 2:
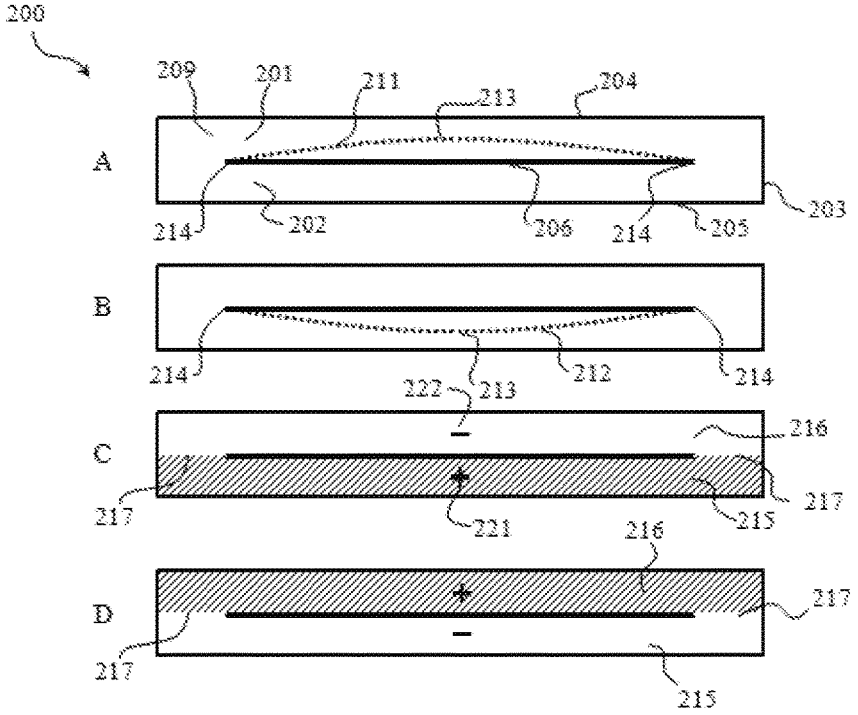

For the cavity shown in FIG. 2, the radial dependence of the amplitude of the pressure oscillations u(r) in the upper cavity portion (201) and lower cavity portion (202) may be approximated by a Bessel function of the first kind, as described by $$u(r)=J_o(k_o r/a) \qquad \text{Equation 4}$$

In this case, the characteristic radius a is primarily influenced by the actuator radius $a_A$ but is also influenced by the cavity radius $a_C$ and the actuator assembly thickness, each of which affects the effective path length for an acoustic wave travelling between the wrapped cavity anti-nodes. Similarly the Bessel function constant $k_0$ is primarily affected by the cavity design and geometry, but is also affected by the actuator assembly thickness and perimeter gap defined by $a_C-a_A$. Depending on these factors, the Bessel function constant $k_0$ will vary from approximately $1.5<k_0<2.5$. Geometrical features which affect the coupling of the standing wave between the upper and lower cavity portions will be described with regard to FIG. 5.

Figure 3:
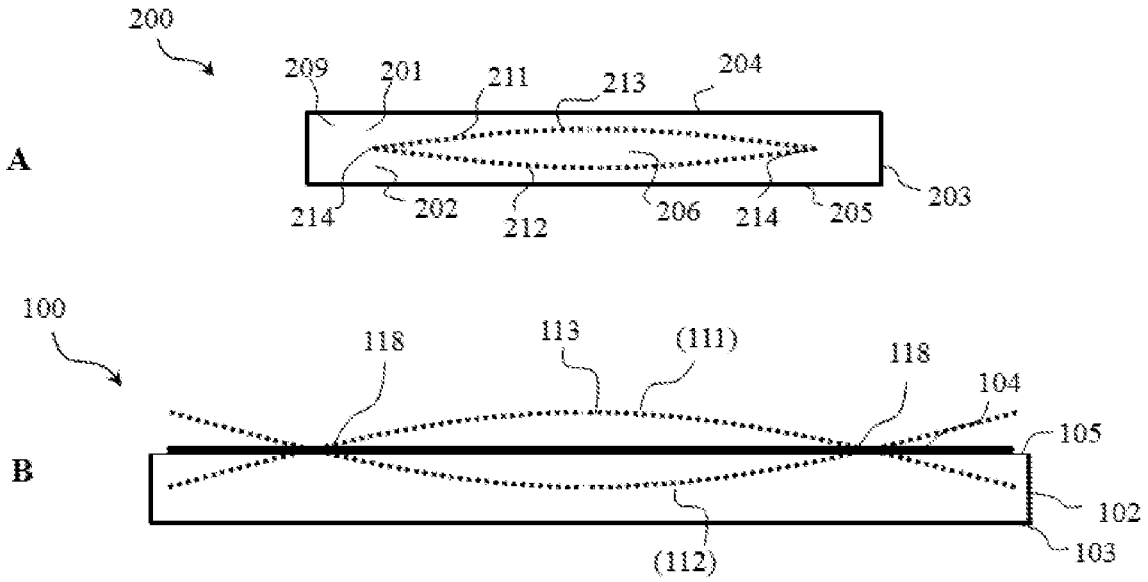

FIG. 3 compares schematic cross-sections showing the driven actuator displacement profiles and cavity diameters of a pump (200) according to the present invention (FIG. 3A) and a pump (100) according to the related art (FIG. 3B). These figures illustrate differences in the cavity diameters and the mounting conditions at the perimeter of the actuators. As described previously, the radial pressure distributions in the two pumps (100) and (200) are described by Bessel functions characterised by the Bessel function constant $k_0$ and the characteristic radius a. The reduction in radius of the present invention (200) over the related art (100) when operating at the same frequency can therefore be quantified in terms of the values of $k_0$ and a, and results in a radius reduction up to 40%.

In both pumps the mounting of the actuator is chosen so as to ensure that the mode-shape of the actuator substantially matches the mode-shape of the pressure oscillations in the cavity, a condition described in the related art as "mode-shape matching". This ensures that the work done by the actuator on the fluid within the cavity adds constructively to the pressure oscillations of the fluid, thereby improving the efficiency of the pump.

In the pump (100) according to the related art, the isolator (105) is designed specifically to allow axial motion of the perimeter of the actuator resulting in a displacement anti-node at the perimeter of the actuator, with a node (118) located within the actuator perimeter at a radius of approximately 0.63 $a_A$, where $a_A$ is the actuator radius.

In this embodiment of the present invention the actuator and related support structure are preferably designed to ensure that the axial motion of the actuator is substantially in phase across the entire actuator so as to provide significant mode-shape matching to the cavity. In a more preferred embodiment the support structure will substantially constrain the axial motion of the actuator (206) at its perimeter, resulting in a displacement node (214) at the perimeter of the actuator. Structures to enable such motion should contact the actuator close to the perimeter, minimise motion of the perimeter of the actuator in the axial direction, and allow small rotations of the actuator with respect to the support structure. One embodiment of the support structure is shown with regard to FIG. 7D in which axial pins above and below the actuator clamp the actuator at the perimeter, providing high resistance to motion of the perimeter of the actuator in the axial direction due to the axial stiffness of the pins, and low resistance to rotation of the actuator due to the small contact area between the pin tips and the actuator. Other support structures are described with regard to FIG. 7.

In the pump described in the related art (100), only the central anti-node (121) can be conveniently accessed with a valved aperture; any unvalved apertures must be at the pressure node and therefore the unvalved apertures must be either through the actuator (104) or end wall (103). In contrast, in pump (200) according to the present invention, both anti-nodes (221) and (222) of the acoustic standing wave can be conveniently accessed with valved apertures at the centres of the end walls (204) and (205), and unvalved apertures can be placed conveniently at the pressure node (217) by creating apertures in the side wall (203). This arrangement provides benefits both with regard to performance and ease of design and assembly.

Figure 4:
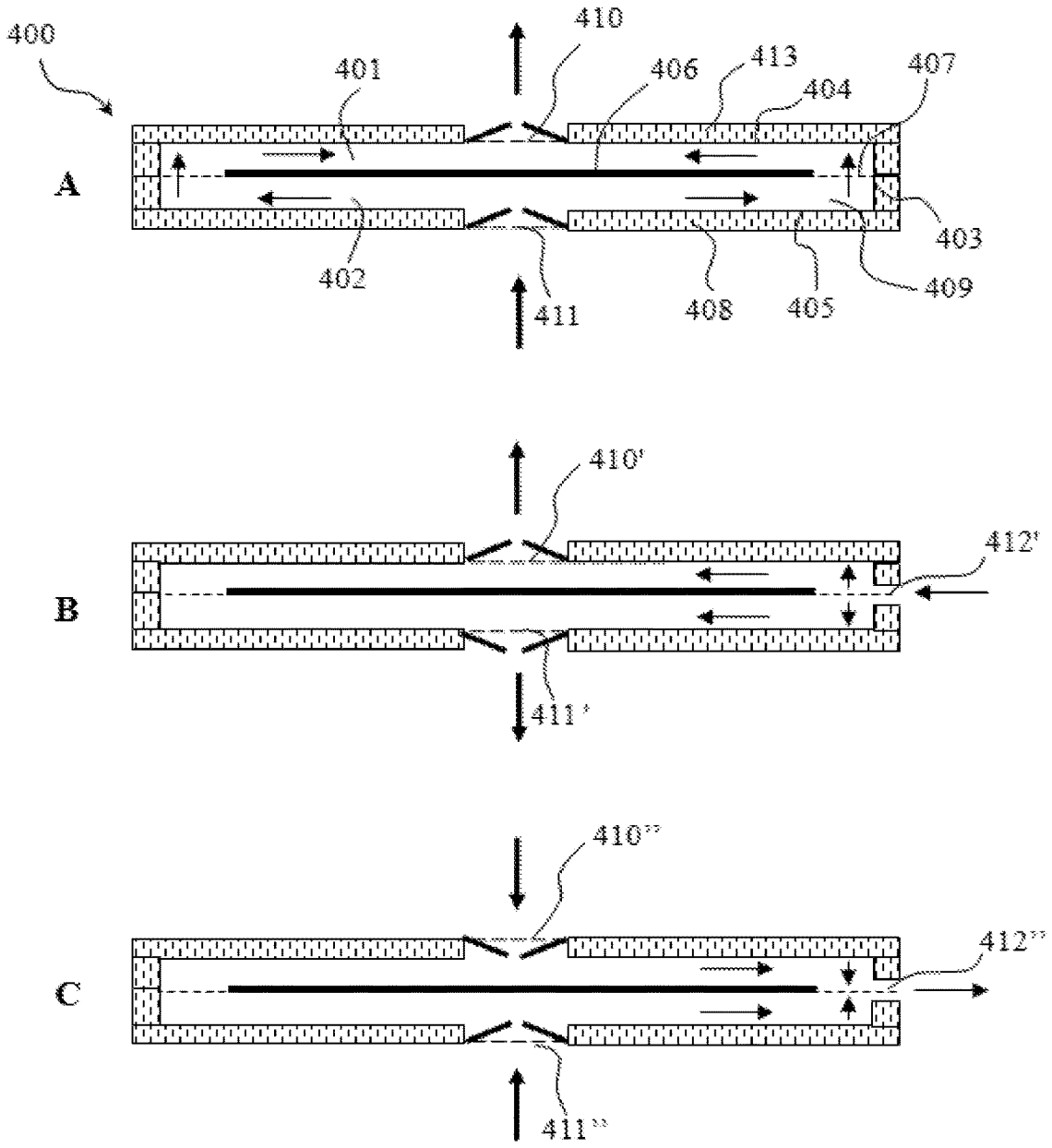

FIGS. 4A-C are schematic cross-sections through a number of further embodiments of a pump (400) according to the present invention. The pump (400) is formed from an upper pump body (413) and a lower pump body (408) which enclose an actuator (406). The actuator (406) is attached to the pump bodies (413) and (408) by a support structure (407) which has a substantially open structure to enable fluid flow around the actuator perimeter. A single cavity (409) is defined by a side wall (403) and two end walls (404) and (405). The cavity (409) encloses the actuator (406), which divides the cavity (409) into two regions; the upper cavity portion (401) and the lower cavity portion (402). The upper and lower cavity portions are fluidically linked through the support structure (407). Two valved apertures (410) and (411) are located at the centres of the end walls (404) and (405).

The arrows in FIGS. 4A-C show the time-averaged flow of fluid through these pump embodiments which arises as a result of fluid flow into and out of the cavity (409) through different arrangements of valved and unvalved apertures. FIG. 4A illustrates the time-averaged flow of fluid entering through a valved aperture (411) located at the centre of the lower end wall (405), passing through the open area of the support structure (407) and exiting through a valved aperture (410) at the centre of the upper end wall (404). Although, typically, optimal pumped flow is achieved by placing a valved aperture at the centre of the end walls, valved apertures can be placed anywhere close to the centre of the end walls. As such, the term "at the centre" is intended to mean "close to the centre" as well.

FIG. 4B shows fluid entering the cavity via an unvalved aperture (412') in the side wall (403) and exiting through a valved aperture (411') at the centre of the lower end wall (405) and a second valved aperture (410') located at the centre of the upper end wall (404). Alternatively, the unvalved aperture could be through either end wall (404 or 405) close to the side wall (403). The unvalved aperture (412') shown represents one or more unvalved apertures which may be located around the perimeter of the pump (400). Finally, FIG. 4C shows fluid entering through valved apertures (410") and (411") and exiting through an unvalved aperture (412") in the side wall (403). Again, multiple unvalved apertures (412") may exist and the unvalved aperture (412") could alternatively be through either end wall (404 or 405) close to the side wall (403).

Figure 5:
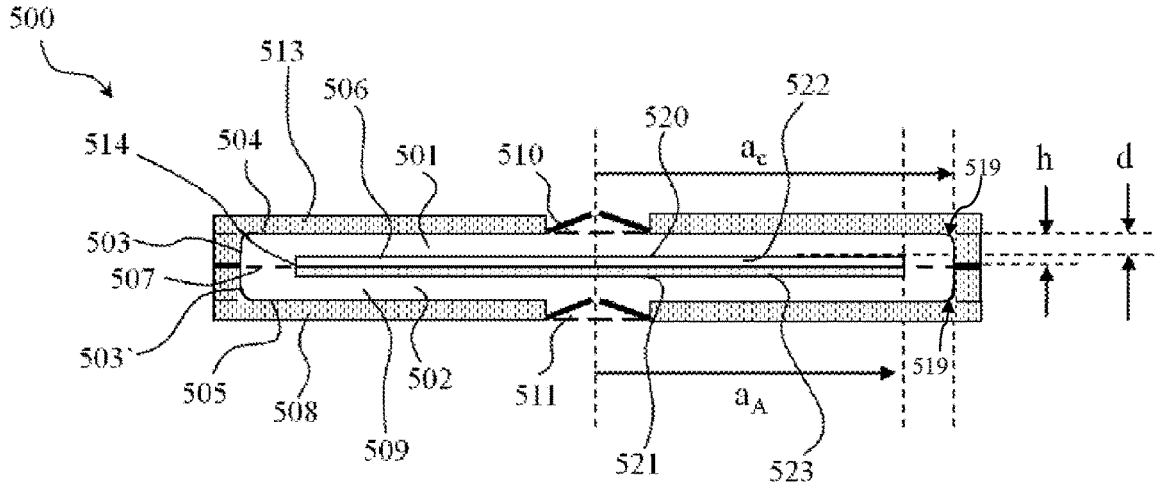
FIG. 5 is a schematic cross-section through an embodiment of the present invention.

FIG. 5 is a schematic cross-section through a pump (500) according to the present invention and defines a number of key dimensions. The pump (500) is formed by joining an upper pump body (513) and a lower pump body (508) about a substantially open support structure (507) and an actuator (506). The upper pump body (513) comprises a substantially cylindrical side wall (503) of height $h_U$ and a substantially circular end wall (504) which when joined to the support structure (507) and actuator (506) define an upper cavity portion (501). The lower pump body (508) comprises a substantially cylindrical side wall (503') of height $h_L$ and a substantially circular end wall (505) which when joined to the support structure (507) and actuator (506) defines a lower cavity portion (502). When joined, the upper pump body and the lower pump body define a substantially cylindrical cavity (509) formed from the upper cavity portion (501) and lower cavity portion (502) which are fluidically joined through the substantially open support structure (507). Elliptical cavity portions and other substantially circular shapes may also be used. The cavity (509) is provided a valved fluid inlet (511) located substantially at the centre of end wall (505) and a valved fluid outlet (510) located substantially at the centre of end wall (504).

An actuator (506) is disposed in a plane substantially parallel to and between the end walls (504) and (505) and between the upper cavity portion (501) and the lower cavity portion (502). The actuator (506) of radius $a_A$ comprises a substantially cylindrical piezoelectric disc (522) attached to a substantially cylindrical metal disc (523). The piezoelectric and metal discs may be of differing diameters so as to facilitate assembly. The total actuator thickness is $t_A$. The piezoelectric disc (522) is not required to be formed of a piezoelectric material, but may be formed of any electrically active material such as, for example, an electrostrictive or magnetostrictive material. As such, the term "piezoelectric disc" is intended to cover electrostrictive or magnetostrictive discs as well.

The distance from the top face of the actuator (520) to the upper end wall (504) is $d_U$, and the distance from the bottom face of the actuator (521) to the lower end wall (505) is $d_L$.

The region of the cavity and end walls within a radius $a_A$ of the cavity axis will henceforth be referred to as the "inner region". The region of the cavity and end walls outside of the actuator radius $a_A$ will henceforth be referred to as the "outer region". When driven, the actuator is caused to vibrate in a direction substantially perpendicular to the plane of the actuator ("axial oscillations"), thereby generating a standing wave in the cavity as discussed with regard to FIG. 2.

The actuator (506) is connected to the upper (513) and/or lower (508) pump bodies by a support structure (507). The support structure (507) is substantially open between the outer regions of the upper cavity portion (501) and the lower cavity portion (502) so as to minimise flow resistance for fluid passing from one cavity portion to the other. The support structure (507) is fixed between the upper pump body (513) and the lower pump body (508) in this example, although it could also connect to one or more of the side walls (503) and (503') and end walls (504) and (505).

The support structure (507) should preferably facilitate the desired actuator motion (211) and (212), to match the radial pressure distribution in the cavity, namely a Bessel function. The displacement profiles (211) and (212) illustrated in FIG. 2A-B are enabled when the support structure (507) significantly constrains the axial motion of the perimeter (514) of the actuator, but allows a 'hinging" action at this point. Additional embodiments of the support structure (507) are further described with regard to FIGS. 6-8.

The actuator is preferably driven at a frequency similar to the resonant frequency of the fluid in the cavity consistent with the wrapped standing wave mode discussed with regards to FIGS. 2C-D. In the wrapped standing wave, fluid oscillates radially in the inner region of each of the upper and lower cavity portions, with the oscillations 'wrapping' around the perimeter of the actuator in the outer regions of the two cavity portions. Radial modes (rather than axial modes) are the lowest-frequency modes of a cylindrical cavity when the cavity radius is greater than 1.2 times the cavity height. The generation of axial modes in the two portions of the cavity would be undesirable as this would lead to inefficiency, therefore it is preferable that:

$$a_C > 1.2d \qquad \text{Equation 5}$$

One skilled in the art will recognise that it is possible to excite higher-order radial modes in the cavity. As described in the related art and with reference to FIG. 1, it is possible to excite a radial mode in the cavity in which there is a pressure anti-node (122) at the perimeter due to reflections of the acoustic wave. The condition $$\frac{a_C}{a_A} < 1.7 \qquad \text{Equation 6}$$

ensures that the lowest frequency mode excited in the cavity is a "wrapped radial mode" rather than a pure radial mode with reflections at the side wall.

The actuator radius is related to the resonant frequency f of fluid in the cavity by the following equation:

$$a_A f = \frac{k_o c}{2\pi} \qquad \text{Equation 7}$$

where c is the speed of sound in the working fluid. For most fluids, $115<c<1970$ m/s, corresponding to $44<a_A*f<754$ m/s.

The amplitude of the standing pressure wave in the cavity may be considered as the product of the actuator velocity v, the density of the fluid p, and the speed of sound in the fluid c, further multiplied by the geometric amplification factor of the cavity a and the resonant quality-factor of the cavity, Q.

The geometric amplification factor $\alpha$ is approximated by $\alpha=a_A/2d$. By increasing the aspect ratio of the cavity (the ratio of its radius to its height), the acoustic pressure oscillation generated by the motion of the actuator is significantly increased. In a preferred example, the amplification factor is greater than 5. Thus the ratio of the actuator radius to the distance to the end wall is preferentially $a_A/d>10$, such that the inner regions formed in the upper and lower cavity portions are disc shape, similar to that of a coin or such like.

A limit on the aspect ratio is provided by the viscous boundary layer thickness. The boundary layer refers to a region of low momentum fluid in the immediate vicinity of a bounding surface where the effects of viscosity are important. The boundary layer thickness ($\delta$) is measured perpendicular to the bounding surface and is given by:

$$\delta = \sqrt{\frac{2\mu}{\rho 2\pi f}} \qquad \text{Equation 8}$$

where $\mu$ is the viscosity of the fluid. In practice, it is preferable for the viscous boundary layer to be less than half the minimum distance between the actuator assembly and the end wall, d, $$d > 2\sqrt{\frac{2\mu}{\rho 2\pi f}} = \sqrt{\frac{8\mu a_A}{\rho k_o c}} \qquad \text{Equation 9}$$

Many applications require a small pump and therefore a small cavity volume V $$V=\pi a_C^2 d_U+\pi a_C^2 d_L+\pi(a_C^2-a_A^2)t_A \qquad \text{Equation 10}$$

In practice the preferred cavity volume of the pump is $V<1\ cm^3$.

As discussed previously, the wrapped standing wave frequency is primarily determined by the actuator radius $a_A$ with secondary effects from the actuator assembly thickness and cavity radius. In a preferred embodiment the operational frequency of the pump is in the range 18-25 kHz such that it is inaudible, and in a range which can be rectified effectively by a flap valve. Given this frequency range, an actuator radius can be determined. In order to minimize the pump volume, the cavity radius should be reduced as far as possible, although this must be balanced with the requirement for relatively unrestricted fluid flow between the upper cavity portion (401) and lower cavity portion (402) such that they behave as a single wrapped cavity.

The design of the cavity geometry will impact how pressure waves in the cavity reflect or transmit as they travel between the upper (501) and lower (502) cavity portions. In a preferred embodiment, a pressure wave travelling between the upper and lower cavity portions will be transmitted efficiently, with minimal reflection of the wave. Reflections of the acoustic wave may arise as a result of solid boundaries in the path of the wave or due to changes in acoustic impedance as the travelling wave travels from the upper cavity portion to the lower cavity portion and vice-versa.

The support structure (507) presents an inevitable obstruction to the acoustic wave. The open area $A_0$ available for flow passing through the support structure (507) should be maximised to minimise flow resistance between the cavity portions and to minimise the obstruction presented to the acoustic wave which could result in reflections. Ideally, the open area $A_0$ will be the entire area available between the actuator perimeter and the cavity side wall (503) and (503'), with no obstruction presented by the support structure:

$$A_0=(\pi a_C^2-\pi a_A^2) \quad \text{Equation 11}$$

In practice, the support structure could block up to half of the available area. Thus $$A_0>0.5(\pi a_C^2-\pi a_A^2) \quad \text{Equation 12}$$

In a preferred embodiment, less than 10% of the available open area will be blocked by the support structure. Thus:

$$A_0>0.9(\pi a_C^2-\pi a_A^2) \quad \text{Equation 13}$$

To avoid significant changes in acoustic impedance as fluid flows from the upper cavity portion (501) to the lower cavity portion (502) the height of the channel defined between the actuator (506) and cavity walls (504), (503), (503') and (505) should remain relatively constant as the acoustic wave travels around the actuator. Ideally there will be no change in channel height and thus:

$$(a_C-a_A)=d \quad \text{Equation 14}$$

In practice, component and assembly tolerances may require that the channel height varies by a factor of ten, and thus:

$$0.1(a_C-a_A)<d<10(a_C-a_A) \quad \text{Equation 15}$$

In a preferred embodiment, the channel height may vary by a factor of two, and thus, $$0.5(a_C-a_A)<d<2(a_C-a_A) \quad \text{Equation 16}$$

Further reduction of reflected acoustic waves may be achieved by smoothing the channel around the perimeter of the actuator (506). This may be achieved by smoothing the corners (519) of the channel by including a radius at the intersection between the side walls (503) and (503') and the end walls (504) and (505). Smoothing the corners (519) of the actuator may also reduce reflected acoustic waves.

Figure 6:
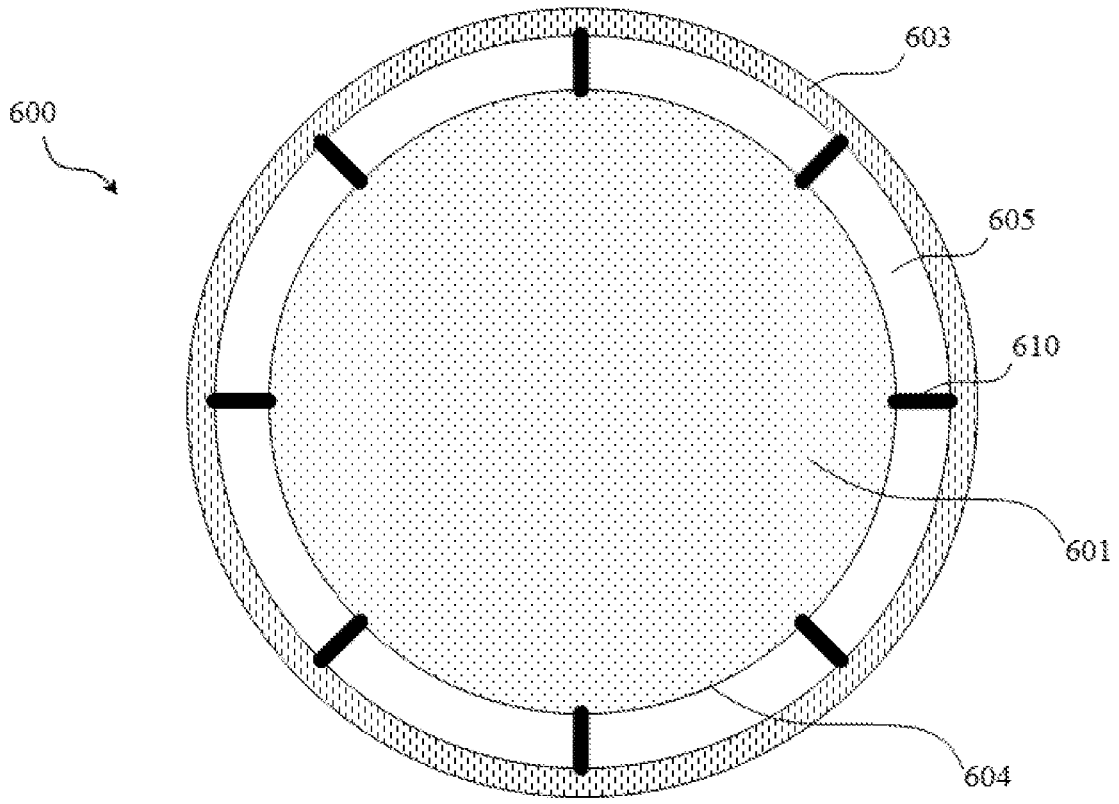
FIG. 6 is a schematic plan view of an embodiment of the present invention.

FIG. 6 is a schematic cross-section in the actuator plane of a pump (600) according to an embodiment of the present invention. The support structure (610) shown is formed from eight legs, connecting the actuator (601) to the side wall (603), constraining the motion of the actuator at its perimeter (604), such that when the actuator (601) undergoes axial oscillations, the perimeter (604) is substantially a node in the axial displacement profile as illustrated in FIG. 2 A-B. The support structure (610) provides eight openings (605) to allow fluid to pass freely between the upper and lower cavity portions. The support structures are small in comparison to the open areas to minimise reflections of the acoustic waves as they pass between the upper cavity portion and lower cavity portion. The support structure may have three or more legs. The support structure has many potential configurations, a selection of which is described with regard to FIGS. 7 and 8.

Figure 7:
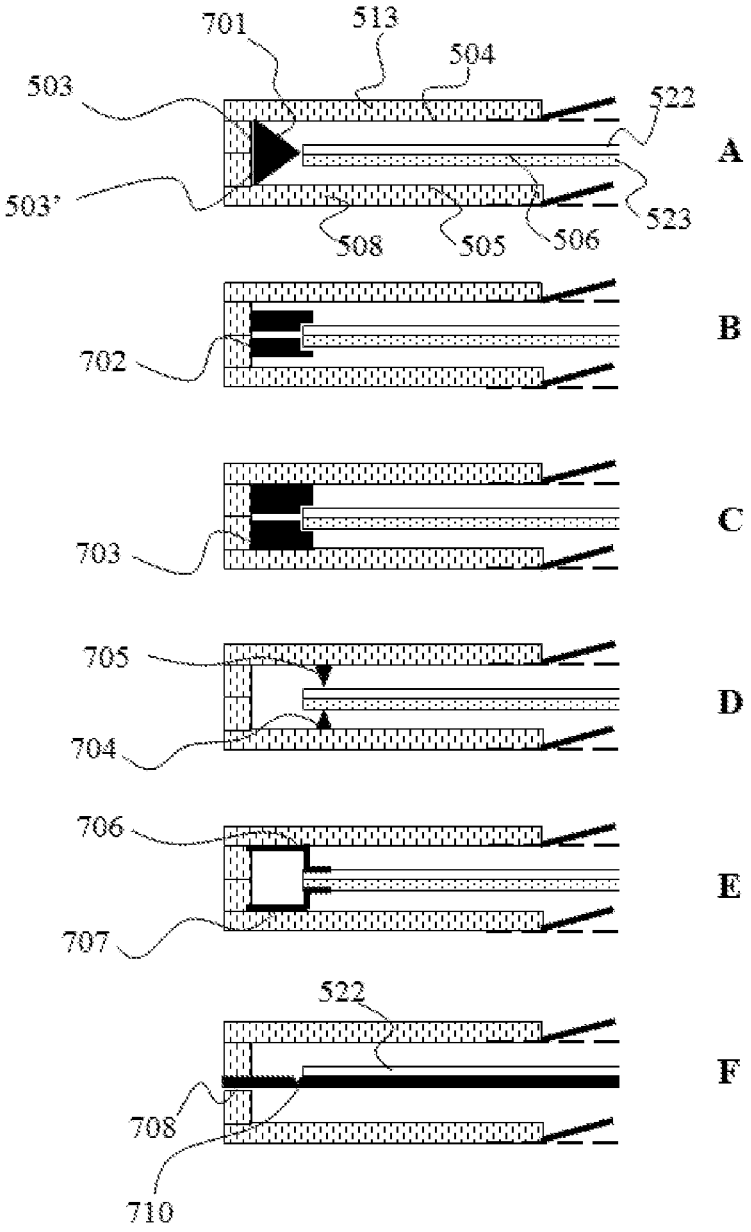

FIGS. 7 A-F are schematic cross-sections which illustrate examples of further support structure embodiments. FIG. 7A shows one embodiment of a support structure (701) which extends from the side walls (503) and (503'), in which the thickness of the support structure reduces as it approaches the perimeter of the actuator to enable appropriate actuator motion, i.e. "hinging" of the actuator at the perimeter without significant axial motion as described in FIG. 2.

FIGS. 7B and C shows embodiments in which two support structures (702) and (703) trap the actuator (506) at the perimeter. The support structure traps only a small proportion of the actuator, enabling rotation of the actuator at the perimeter, but preventing axial motion. FIG. 7B shows a support structure (702) which extends from the side walls (503) and (503'). FIG. 7C shows a support structure (703) which extends from the side walls (503) and (503') and the end walls (504) and (505).

FIG. 7D. shows an embodiment in which the actuator (506) is trapped between two "pin" support structures (704) and (705). These support structures provide point contacts with the actuator close to the perimeter, enabling rotation of the actuator, but preventing axial motion. In this case there may be no bond between the support structures (704) and (705), and the actuator (506).

FIG. 7E shows an embodiment in which the actuator is joined to two support structures (706) and (707) which may be joined to the actuator and which locate the actuator when it is placed into the pump bodies (508) and (513). In this case there may be no bond between the support structure and the pump bodies (508) and (513).

FIG. 7F shows an embodiment in which the substrate (708) and support structure are both formed from the same component. In this embodiment a piezo disc (522) is joined to the substrate (708) which has a disc shaped central region and support features outside the perimeter of the piezoelectric disc (522). In this case support structures are shown with a thinned section (710) close to the perimeter of the piezoelectric disc (522) to provide the "hinging" motion of the actuator. This feature may be achieved by machining, spark eroding, chemical etching or other known techniques.

In all embodiments illustrated in FIGS. 7A-F, the supports structures may consist of one single structure or multiple structures distributed about the perimeter of the actuator (506). The support structures may be moulded as part of the pump bodies (513) and (508), provided as separate components, or form a part of the actuator assembly (506). The material and stiffness properties may or may not be uniform across the structure. In one embodiment the support structure and the substrate (523) may be the same component. The join between the support structures, actuator and pump bodies may be achieved by adhesive, ultrasonic weld, clamping, pressure fit, or other known methods which may be mechanical, chemical, or non-mechanical, non-chemical.

In all cases described above, the support structures should avoid significant reflections of acoustic travelling waves passing through the structure as well as avoiding significant flow restriction.

Figure 8:
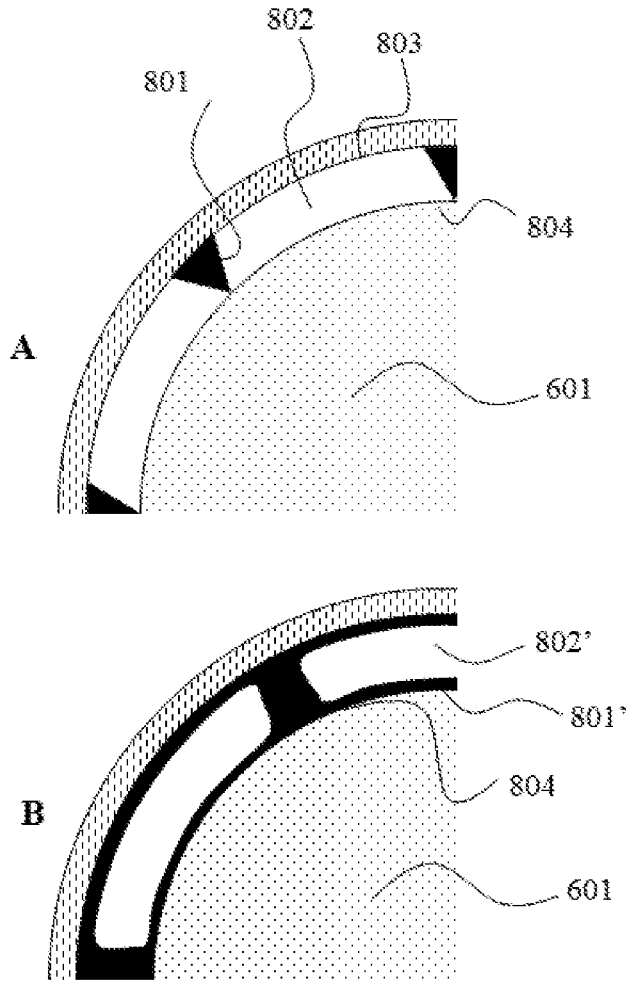

FIGS. 8 A-B are schematic plan views illustrating examples of support structure embodiments with open area between the upper and lower cavity portions. FIG. 8A illustrates an example of the support structure (801) comprising either a number of discrete connector elements or a single sheet including perforations (802). This embodiment provides stiffness near the outer perimeter (803) of the cavity and more flexibility close to the perimeter (804) of the actuator assembly (601) by a change in support structure width. FIG. 8B shows a support structure (801') which is composed of a single component with perforations (802') to provide the open area through the support structure. In this embodiment, the size and shape of the perforations (802') are only illustrative, and a range of sizes and shapes are possible. The sheet structure may be composed of one or more parts, in order to allow flexibility near the perimeter (804) of the actuator assembly (601). The sheet structure may also form the actuator substrate.

FIGS. 9A-C are schematic cross-sections which illustrate three methods of providing electrical connections to a piezoelectric disc in an actuator. FIG. 9A shows an actuator, comprising a piezoelectric disc (902) bonded to a conductive substrate (904). The piezoelectric disc (902) has an upper electrode (901) and lower electrode (903). These electrodes allow the actuator to be actuated by applying a voltage across the electrodes. The actuator is held by a support structure (905) which also provides an electrical connection to the substrate and so to the lower electrode (903). Connection to the upper electrode (901) is provided by a separate connection (906) which may be a wire, a spring contact, a flexible printed circuit or other method of forming electrical connection. In a preferred embodiment, the connection (906) will provide minimal damping of the actuator motion.

FIG. 9B shows an actuator, comprising a piezoelectric disc (912) bonded to a substrate (914). The piezoelectric disc (912) has an upper electrode (911) and lower electrode (913). The upper electrode (911) has a 'wrap' electrode (917) which electrically connects the upper electrode to a portion of the lower surface of the piezoelectric disc which is isolated from the lower electrode (913). The actuator is held by a support structure (915) and (916) which also provides two isolated electrical connections to the upper electrode (911) via the 'wrap' (912) and the lower electrode (913).

In one embodiment, the substrate (914) and support structure (915) and (916), may be a single component. In this embodiment the substrate/support component may be formed from an insulating material with a series of conductive tracks created on the surface to selectively connect to the two electrodes. In an alternative embodiment, the substrate/support may be a metallic material with a series of conductive tracks created on the surface which are isolated from the substrate by an insulation layer. The insulation layer may be achieved by anodising the surface of the metallic component, an insulating coating or by other known methods.

FIG. 9C shows an actuator, comprising a piezoelectric disc (922) bonded to a substrate (924). The piezoelectric disc (922) has an upper electrode (921) and lower electrode (923). The actuator is trapped between two "pin" support structures (927) and (928) contacting above and below the actuator within a cavity (926). The top support (927) provides electrical connection to the upper electrode (921) and the lower support (928) provides electrical connection to the conductive substrate (924) and therefore to the lower electrode (923). These support structures may also provide the desired actuator motion as described with regard to FIG. 7D.

FIG. 10 shows schematic cross-section of a flap valve described in the related art (PCT/GB2009/050614 application) which may be used to enable rectification of a high frequency pressure oscillation. The valve (1000) comprises a valve flap (1017), having a plurality of holes (1022), constrained between a retention plate (1014), having a plurality of holes (1018), and a sealing plate (1016), having a plurality of holes (1020). The gap between the retention plate (1014) and the sealing plate (1016) (the 'valve gap' $d_{gap}$) is defined by a ring shaped spacer layer (1012) which also clamps the valve flap (1017). The valve flap holes (1022) and the retention plate holes (1018) are aligned to as to enable fluid flow when the valve flap (1017) is biased up against the retention plate (1014) (the "open" position). The valve flap holes (1022) and sealing plate holes (1020) are offset so as to provide a fluid seal when the valve flap (1017) is biased against the sealing plate (1016) (the "closed" position). In use, the valve flap (1017) is moved between "open" and "closed" positions by alternating pressures across the valve, by the oscillating fluid pressure in the pump cavity.

In one embodiment of the present invention, an acoustic resonance pump which operates at between 18 kHz and 25 kHz comprises the following:

Upper and lower pump bodies which may be moulded or machined plastic or metal, each having a cavity radius $a_C$ of between 2 mm and 90 mm, and a side wall height h of between 0.1 mm and 5 mm, and valved apertures at the centres of each end wall. More preferably, the pump bodies will be moulded plastic with a cavity radius of about 10 mm, and side wall heights of about 0.5 mm. The end walls of the upper and lower cavities may be flat or shaped to intensify the pressure at the centre of the cavity. One method for achieving this is for the end walls to be frustro-conical in shape. Consequently the gap between the actuator and the end wall is smaller in the centre of the cavity and larger at the perimeter. An actuator comprising a piezoelectric disc radius $a_A$ of between 2 mm and 90 mm and having a thickness of between 0.1 mm and 1 mm bonded to a substrate which also acts as the support structure. The substrate is made of sheet steel or aluminium between 0.1 mm and 2 mm in thickness and is formed from a central disc of radius $a_A$ connected to an outer ring of inner radius $a_C$ by three or more "legs". These legs may have variable width or thickness to enable "hinging" of the actuator at the support. Electrical connections are provided to the lower and upper electrodes via the substrate (lower) and a separate electrical connection to the upper electrode which may be a light wire or a spring contact.

Flap valves in which the valve flap may be formed from a thin polymer sheet between 1 μm and 20 μm in thickness, the valve gap may be between 5 μm and 150 μm and the holes in the retention plate, sealing plate and valve flap being between about 20 μm and 500 μm in diameter. More preferably the retention plate and the sealing plate are formed from sheet steel about 100 μm thick, and chemically etched holes are about 150 μm in diameter. The valve flap is formed from polyethylene terephalate (PET) and is about 2 μm thick. The valve gap '$d_{gap}$' is around 20 μm.

The invention claimed is:

1. A fluid pump, comprising: a pump body having upper and lower parts, each part comprising a substantially cylindrical side wall closed at one end by a substantially circular end wall, the upper and lower parts together arranged to form a single cavity which is bounded by the end walls and side walls of the pump body; an actuator disposed within the cavity in a plane substantially parallel to and between the end walls such that the cavity is divided into upper and lower portions by the actuator; at least one valved aperture located substantially at the centre of each end wall of both the upper and lower parts of the pump body; and an actuator support structure connecting the actuator to the pump body; wherein the actuator support structure is arranged to allow the actuator to hinge at its perimeter while substantially constraining axial motion of said perimeter such that said perimeter is substantially stationary, the support structure being substantially open to enable free flow of fluid between the upper and lower cavity portions; and wherein, in use, the actuator oscillates in a direction substantially perpendicular to the plane of the end walls causing an acoustic wrapped standing wave to exist in the cavity and thereby causing fluid flow through said apertures; wherein the perimeter of the actuator forms a continuous circle from which the actuator support structure extends.

2. A pump according to claim 1 wherein one or more unvalved apertures is located in the side walls of the cavity or in an end wall of the cavity and adjacent the side walls.

3. A pump according to claim 1 wherein the valves are flap valves.

4. A pump according to claim 3 wherein at least one of said flap valves comprises a valve flap formed from a polymer sheet of between 1 micron and 20 microns in thickness.

5. A pump according to claim 1 wherein the valved aperture located substantially at the centre of the lower end wall is an inlet aperture, and the valved aperture located substantially at the centre of the upper end wall is an outlet aperture.

6. A pump according to claim 2 wherein the valved apertures located substantially at the centre of each end wall of both the upper and lower parts of the pump body are both inlet apertures, and the one or more unvalved aperture located in the side walls of the cavity or in an end wall of the cavity and adjacent the side walls of the pump body is an outlet aperture.

7. A pump according to claim 2 wherein the valved apertures located substantially at the centre of each end wall of both the upper and lower parts of the pump body are outlet apertures and the one or more unvalved aperture located in the side walls of the cavity or in an end wall of the cavity and adjacent the side walls of the pump body is an inlet aperture.

8. A pump according to claim 1 wherein a ratio of the actuator radius ($a_A$) to each of the cavity portion heights measured at the side wall (d), is greater than 1.2.

9. A pump according to claim 1 wherein a ratio of each of the upper and lower cavity portion radii ($a_C$) to the actuator radius ($a_A$) is less than 1.7.

10. A pump according to claim 1 wherein the cavity volume is less than 1 $cm^3$.

11. A pump according to claim 1 wherein the operational frequency of the pump is between 18 kHz and 25 kHz.

12. A pump according to claim 1 wherein a ratio of twice the cavity portion heights measured at the side wall (d) to the actuator radius ($a_A$) is greater than $10^{-9}$, in other words, $2d/a_A>10^{-9}$.

13. A pump according to claim 1 wherein the product of the actuator radius ($a_A$) and the resonant frequency (f) of fluid in the cavity is within the range 44 m/s<$a_A$*f<754 m/s.

14. A pump according to claim 1 wherein a ratio of the actuator radius ($a_A$) to each of the cavity portion heights measured at the side wall (d), is greater than 5.

15. A pump according to claim 1 wherein an open area ($A_0$) available for flow passing through the actuator support structure between the upper and lower cavity portions is greater than half of the area cavity and actuator radii, in other words, $$A_0>0.5(\pi a_C^2-\pi a_A^2)$$

wherein ($a_A$) is actuator radius, and ($a_C$) is the upper and lower cavity portion radii.

16. A pump according to claim 15 wherein the open area ($A_0$) available for flow passing through the actuator support structure between the upper and lower cavity portions is greater than 90% of the area cavity and actuator radii, in other words, $$A_0>0.9(\pi a_C^2-\pi a_A^2)$$

wherein ($a_A$) is actuator radius, and ($a_C$) is the upper and lower cavity portion radii.

17. A pump according to claim 1 wherein each of the cavity portion heights measured at the side wall (d) are within the range:

$$0.1(a_C-a_A)<d<10(a_C-a_A)$$

wherein ($a_A$) is actuator radius, and ($a_C$) is the upper and lower cavity portion radii.

18. A pump according to claim 1 wherein each of the cavity portion heights measured at the side wall (d) are within the range:

$$0.5(a_C-a_A)<d<2(a_C-a_A)$$

wherein ($a_A$) is actuator radius, and ($a_C$) is the upper and lower cavity portion radii.

19. A pump according to claim 1 wherein the actuator support structure is formed from a single etched component.

20. A pump according to claim 1 wherein the actuator support structure forms part of an actuator assembly or part of the upper and/or lower parts of the pump body.

21. A pump according to claim 1 wherein the internal corners of the pump body between the side walls and end walls of the cavity are curved so as to reduce reflection of the acoustic wave at the perimeter of the cavity.

22. A pump according to claim 4 wherein the at least one valve flap includes more than ten apertures which enable the flow of air through the at least one valve flap when in an open position.

* * * * *